US010406405B2

(12) United States Patent
Smith

(10) Patent No.: US 10,406,405 B2
(45) Date of Patent: Sep. 10, 2019

(54) SYSTEM FOR PACKAGING GOLF BALLS

(71) Applicant: Lowell R. Smith, Kansas City, MO (US)

(72) Inventor: Lowell R. Smith, Kansas City, MO (US)

( * ) Notice: Subject to any disclaimer, the term of this patent is extended or adjusted under 35 U.S.C. 154(b) by 0 days.

(21) Appl. No.: 15/667,110

(22) Filed: Aug. 2, 2017

(65) Prior Publication Data

US 2019/0038942 A1 Feb. 7, 2019

(51) Int. Cl.

| | |
|---|---|
| ***B65D 77/00*** | (2006.01) |
| ***B65D 71/00*** | (2006.01) |
| ***A63B 47/00*** | (2006.01) |
| ***A63B 55/20*** | (2015.01) |
| ***B65D 71/52*** | (2006.01) |
| ***B65B 1/00*** | (2006.01) |
| *A63B 37/00* | (2006.01) |

(52) U.S. Cl.

CPC ..... *A63B 47/002* (2013.01); *A63B 55/20* (2015.10); *B65B 1/00* (2013.01); *B65D 71/0003* (2013.01); *B65D 77/003* (2013.01); *A63B 37/0003* (2013.01)

(58) Field of Classification Search

CPC ..... A63B 63/00; A63B 69/0026

USPC ..... 473/136, 137, 134; 221/22, 290; 273/201; 222/452

See application file for complete search history.

(56) References Cited

U.S. PATENT DOCUMENTS 3,248,008 A * 4/1966 Meierjohan ..... A47F 1/03 221/180
3,508,680 A * 4/1970 Casey ..... B65G 47/00 221/258
3,946,847 A * 3/1976 Bock ..... G07F 5/02 194/253
4,054,197 A * 10/1977 Bock ..... G07F 11/44 194/238

(Continued)

*Primary Examiner* — Gene O Crawford
*Assistant Examiner* — Ayodeji T Ojofeitimi
(74) *Attorney, Agent, or Firm* — Murtha Cullina LLP; Anthony P. Gangemi

(57) ABSTRACT

Methods and systems for packaging a plurality of objects are disclosed. The system includes a base tray having a first end and a second end, an object reservoir positioned at the first end, a dispensing guide positioned at the second end, and a column guide disposed between the reservoir and the dispensing guide. The column guide is configured to convey objects from the reservoir to the dispensing guide using gravitational forces via a plurality of longitudinally extending guiding columns. A tilt tray having a front edge and a back edge is positioned above the column guide. The tilt tray has a front edge and a back edge, and is anchored to pivot between a forward-engaged position and a backward-engaged position. When the tilt tray is in the backward-engaged position, the back edge is positioned to prevent object movement along the column guide, while the front edge is positioned to allow object movement along the column guide and into the dispensing guide. When the tilt tray is in the forward-engaged position, the front edge is positioned to prevent object movement along the column guide and into the dispensing guide, while the back edge is positioned to allow objects to pass underneath the back edge. The system is sized and configured for packaging golf balls in interchangeable object containers.

16 Claims, 5 Drawing Sheets

(56) References Cited

U.S. PATENT DOCUMENTS

| | | | | | |
|---|---|---|---|---|---|
| 4,441,717 | A * | 4/1984 | Willcox | A63B 57/0006 | 473/134 |
| 4,588,108 | A * | 5/1986 | Knez | A47F 1/03 | 221/266 |
| 4,667,847 | A * | 5/1987 | Tucom | A63B 47/002 | 221/183 |
| 4,712,712 | A * | 12/1987 | Garden | A63B 47/002 | 221/151 |
| 5,071,131 | A * | 12/1991 | Turnidge | A63B 47/002 | 473/137 |
| 5,077,854 | A * | 1/1992 | Moons | A63B 47/04 | 134/133 |
| 5,277,331 | A * | 1/1994 | Barbaccia | A63B 47/002 | 221/15 |
| 5,282,628 | A * | 2/1994 | Komori | A63B 47/002 | 473/136 |
| 5,674,130 | A * | 10/1997 | Egan | A63B 57/0006 | 473/132 |
| 5,772,778 | A * | 6/1998 | Back | A63B 47/002 | 134/25.4 |
| 6,419,589 | B1 * | 7/2002 | Carter | A63B 57/0006 | 221/277 |
| 6,929,556 | B1 * | 8/2005 | Wolbert | A63B 57/0006 | 473/137 |

* cited by examiner

SYSTEM FOR PACKAGING GOLF BALLS

BACKGROUND

There is a need for an improved system for packaging small objects into uniform containers. Inexpensive small objects, such as golf balls, are rarely sold individually, but rather in a package containing multiple examples of the object. In addition to being more economical, these objects are provided in packaged groups because when not bound together, their handling becomes unwieldy, particularly for spherical objects like golf balls that can roll away from an individual simply by gravity. However, packaging these objects by hand is inefficient, particularly if uniform distribution of objects across a number of packages is desired.

SUMMARY

Some embodiments of the disclosed subject matter are directed to an object packaging system including a base tray having a first end and a second end. In some embodiments, an object reservoir is positioned at the first end, the reservoir having side walls, at least one vertical baffle, and at least one horizontal baffle. In some embodiments, a dispensing guide is positioned at the second end. In some embodiments, a dispensing conduit is connected to the dispensing guide. In some embodiments, a column guide is disposed between the reservoir and the dispensing guide. The column guide is configured to convey objects from the reservoir to the dispensing guide and then to an interchangeable object container. In some embodiments, the objects are conveyed along the column guide using gravitational forces. In some embodiments, the column guide is composed of a plurality of longitudinally extending guiding columns. In some embodiments, the at least one horizontal baffle extends longitudinally along the column guide.

In some embodiments, a tilt tray is positioned above the column guide. The tilt tray has a front edge and a back edge, and is anchored to pivot between a forward-engaged position and a backward-engaged position. When the tilt tray is in the backward-engaged position, the back edge is positioned to prevent object movement along the column guide, while the front edge is positioned to allow object movement along the column guide and into the dispensing guide. When the tilt tray is in the forward-engaged position, the front edge is positioned to prevent object movement along the column guide and into the dispensing guide, while the back edge is positioned to allow objects to pass underneath the back edge. In some embodiments, the system is sized and configured for packaging golf balls in the interchangeable object containers.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Figure 1A:
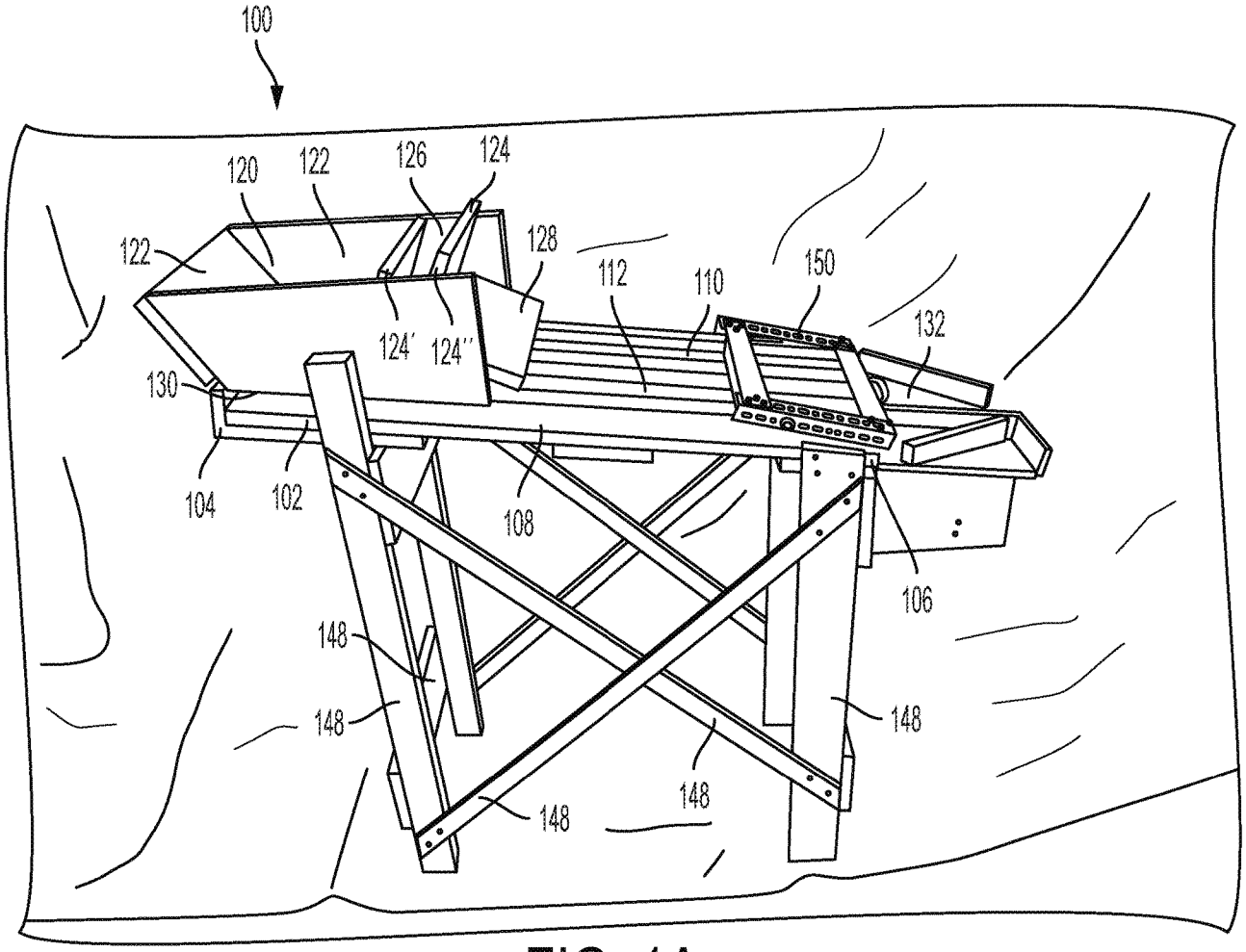
FIG. 1A a schematic diagram of a system for packaging objects according to some embodiments of the present disclosure.

Referring now to FIG. 1A, aspects of the disclosed subject matter include a system 100 for packaging objects. In some embodiments, the objects to be packaged are any substantially spherical object. In some embodiments, the objects are approximately the size of a regulation golf ball. In some embodiments, the objects are golf balls.

In some embodiments, system 100 includes a base tray 102 having a first end 104 and a second end 106. In some embodiments, base tray 102 is substantially level. In some embodiments, base tray 102 is inclined. In some embodiments, first end 104 is at a higher elevation than second end 106. In some embodiments, base tray 102 includes side walls 108.

Figure 1B:
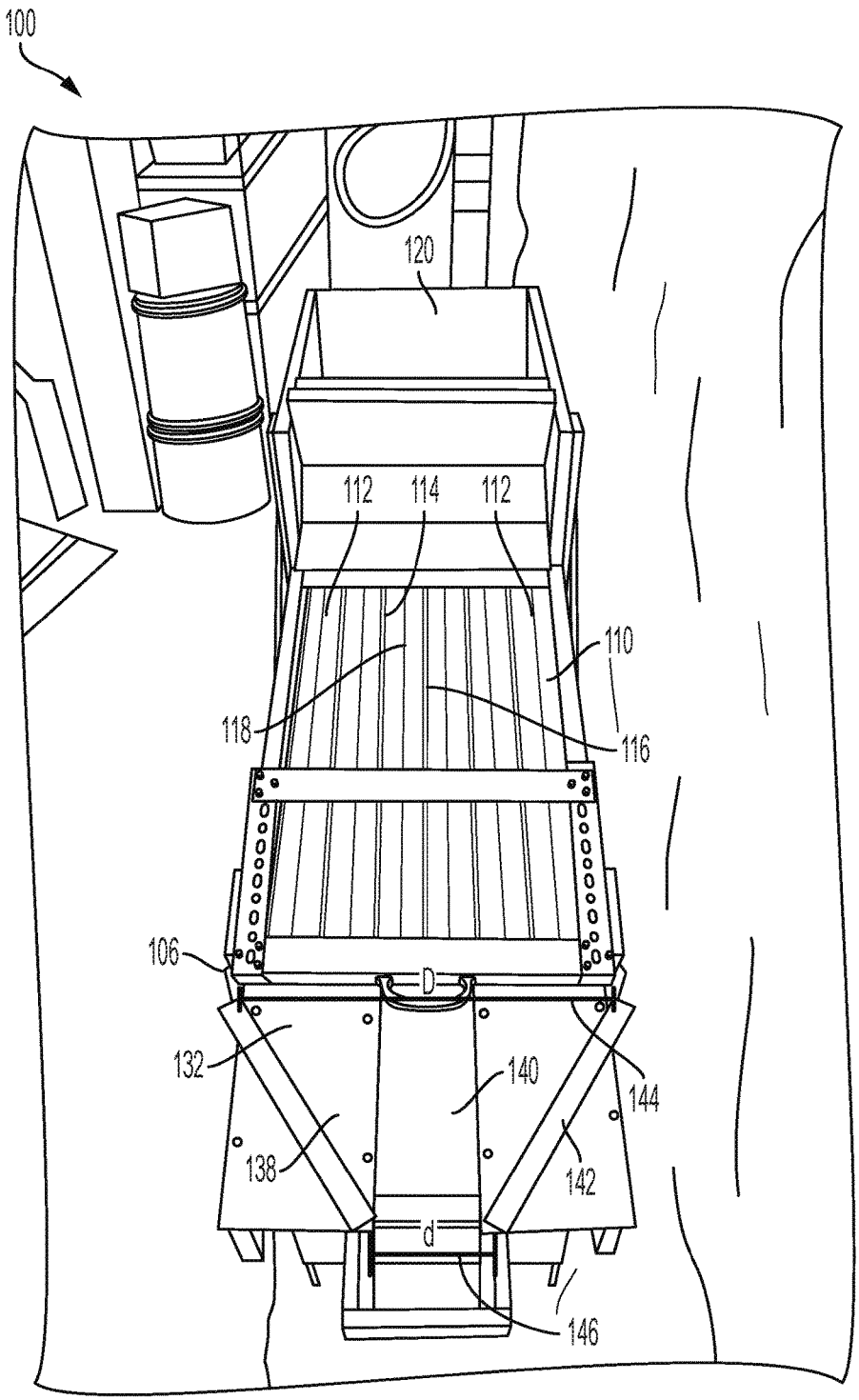
FIG. 1B a schematic diagram of a system for packaging objects according to some embodiments of the present disclosure.

Referring now to FIG. 1B, in some embodiments, system 100 includes an inclined column guide 110 positioned on base tray 102. In some embodiments, inclined column guide 110 includes at least one guiding column 112. In some embodiments, inclined column guide 110 includes a plurality of guiding columns 112. Guiding columns 112 extend along inclined column guide 110 in the direction of the incline. In some embodiments, inclined column guide 110 is substantially parallel to base tray 102. In some embodiments, guiding columns 112 include a first edge 114, a second edge 116, and a recess 118 between the first and second edges. In some embodiments, guiding columns 112 are sized to receive an object and configured to have the object slide or roll in a direction from first end 104 to second end 106. In some embodiments, guiding column 112 is sized to receive a single column of golf balls. In some embodiments, guiding columns 112 are substantially uniformly sized. In some embodiments, guiding columns 112 are differentially sized. In some embodiments, system 100 includes a plurality of inclined column guides 110.

Referring again to FIG. 1A, in some embodiments, system 100 includes a reservoir 120 positioned at first end 104. In some embodiments, reservoir 120 is positioned above first end 104. In some embodiments, reservoir 120 is positioned above inclined column guide 110. In some embodiments, reservoir 120 is positioned and configured to receive into system 100 objects provided by an external source and communicate those objects to inclined column guide 110. In some embodiments, reservoir 120 includes side walls 122. Reservoir 120 may have any number of side walls 122 so long as objects provided to the reservoir are directed to inclined column guide 110. In some embodiments, reservoir 120 includes at least one vertical baffle 124. In some embodiments, reservoir 120 includes two or more vertical baffles 124. Vertical baffles 124 are positioned to help receive objects from an external source and facilitate flow of objects out of reservoir 120 and along inclined column guide 110. In some embodiments, reservoir includes inner vertical baffle 124' and outer vertical baffle 124". In some embodiments, a recess 126 is disposed between inner vertical baffle 124' and outer vertical baffle 124". In some embodiments, a horizontal baffle 128 extends from reservoir 120 longitudinally along inclined column guide 110. Horizontal baffle 128 is configured to prevent objects from bouncing off and/or out of system 100, particularly out of inclined column guide 110. In some embodiments, horizontal baffle 128 is positioned to only allow a single layer of objects to flow out of reservoir 120 and along inclined column guide 110.

In some embodiments, reservoir 120 includes a reservoir base 130. In some embodiments, reservoir base 130 is substantially planar. In some embodiments, reservoir base 130 is bowl shaped. In embodiments where reservoir 120 is positioned on inclined column guide 110, reservoir base 130 may be the inclined column guide itself.

Figure 1C:
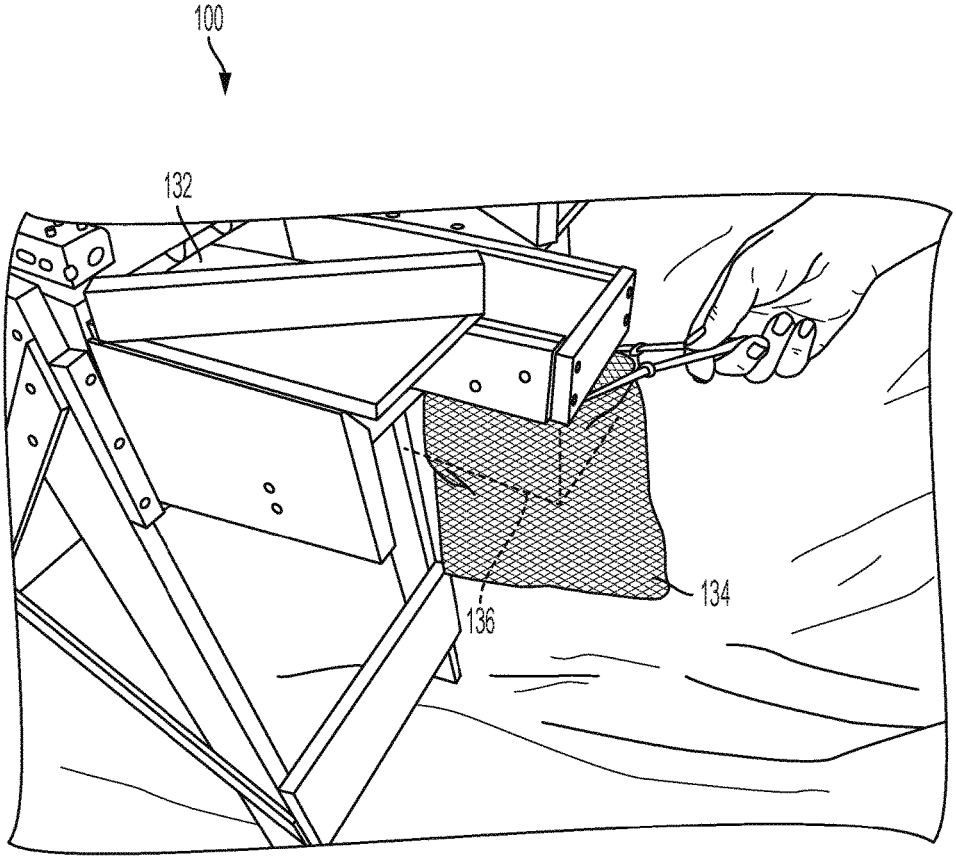
FIG. 1C a schematic diagram of a system for packaging objects according to some embodiments of the present disclosure.

In some embodiments, system 100 includes a dispensing guide 132 positioned at second end 106. In some embodiments, dispensing guide 132 is positioned below inclined column guide 110. In some embodiments, dispensing guide 132 is positioned to receive objects provided by inclined column guide 110. Referring now to FIG. 1C, dispensing guide 132 is positioned and configured to direct objects provided by inclined column guide 110 to an object container 134. In some embodiments, object container 134 is any suitable interchangeable container, such as a bag, box, bucket, etc. In some embodiments, dispensing guide 132 is in communication with a dispensing conduit 136, which is itself in communication with object container 134. Referring again to FIG. 1B, in some embodiments, dispensing guide 132 includes a base 138 and a trough 140 extending along the base. In some embodiments, trough 140 is in communication with object container 134. In some embodiments, trough 140 is in communication with dispensing conduit 136. In some embodiments, dispensing guide 132 includes non-parallel guiding walls 142 configured to funnel objects from inclined column guide 110 towards object container 134. In some embodiments, non-parallel guiding walls 142 are positioned with a first distance D at a wide end 144 and a second distance d at a narrow end 146. In some embodiments, first distance D is approximately 6 golf balls wide. In some embodiments, second distance dis less than 6 golf balls wide. In some embodiments, second distance dis approximately 2 golf balls to approximately 3 golf balls wide. In some embodiments, second distance dis approximately 2 golf balls wide. In some embodiments, second distance d is approximately 3.5 inches. In some embodiments, second distance d is less than 2 golf balls wide. In some embodiments, first distance D is approximately the width of inclined column guide 110.

Referring again to FIG. 1A, in some embodiments, system 100 is configured without base tray 102. In these embodiments, reservoir 120, inclined column guide 110, and dispensing guide 132 have their own bases or constitute bases themselves upon which objects to be packaged by system 100 may rest or be conveyed along through the system. Further, in these embodiments, first end 104 and second end 106 may be considered to be the ends of reservoir 120, inclined column guide 110, and/or dispensing guide 132 as the case may be and as would be understood by those of skill in the art. In some embodiments, system 100 includes one or more stabilizing apparatus 148. Stabilizing apparatus 148 is positioned and configured to limit movement of system 100 while in use, and further to position the system at a desirable height for a system user. FIG. 1A portrays a system of legs and cross-braces. However, those having skill in the art would understand that other solutions for stabilizing apparatus 148 may be implemented.

Figure 1D:
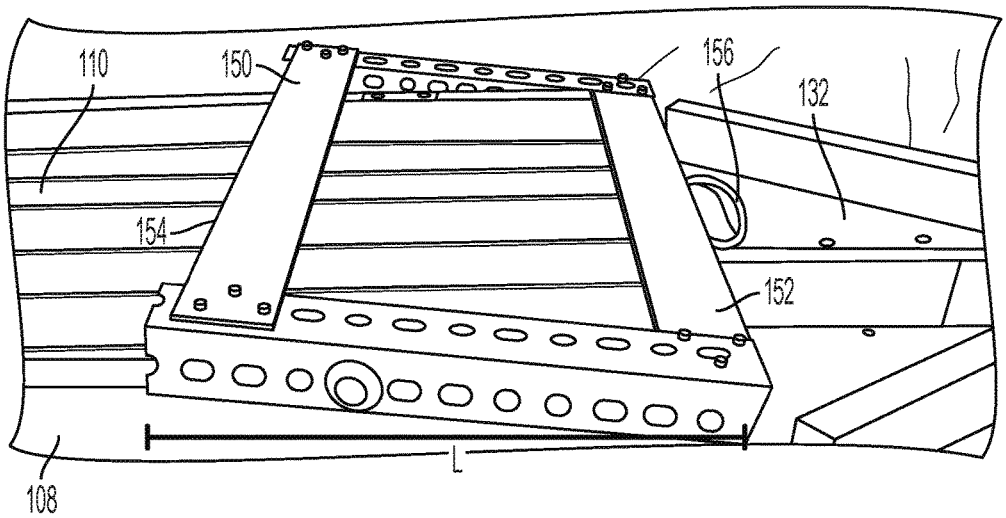
FIG. 1D a schematic diagram of a system for packaging objects according to some embodiments of the present disclosure.
Figure 1E:
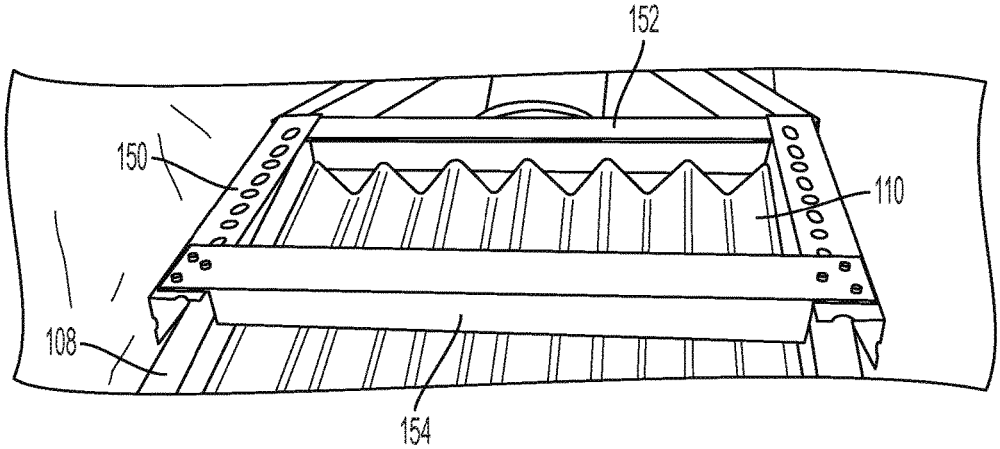
FIG. 1E a schematic diagram of a system for packaging objects according to some embodiments of the present disclosure.

In some embodiments, a tilt tray 150 is positioned above inclined column guide 110. Referring now to FIGS. 1D and 1E, tilt tray 150 is anchored to pivot between a forward-engaged position and a backward-engaged position. In some embodiments, tilt tray 150 is anchored to base tray 102. In some embodiments, tilt tray 150 is anchored to side walls 108. In some embodiments, tilt tray 150 is anchored to inclined column guide 110. In some embodiments, tilt tray 150 includes a front edge 152 and a back edge 154. As used herein, objects described as being "above" and "below" back edge 154 refer to how far they have moved along inclined column guide 110; objects that have not yet reached back edge 154 are "above" the back edge and objects that have passed back edge 154 are "below" the back edge. When tilt tray 150 is in forward-engaged position, such as that seen in FIG. 1D, back edge 154 is raised to a first height above inclined column guide 110 and front edge 152 is lowered to a fourth height above inclined column guide 110. Likewise, when tilt tray 150 is in backward-engaged position, and back edge 154 is lowered to a second height above inclined column guide 110 and front edge 152 is raised to a third height above inclined column guide 110. The "lowered" second and fourth heights are sized to stop objects from progressing along inclined column guide 110 by preventing the objects from passing under back edge 154 and front edge 152 respectively. Likewise, the "raised" first and third heights are sized to enable objects to progress along inclined column guide 110 by allowing the objects to pass under back edge 154 and front edge 152 respectively. As the tilt tray pivots between forward-engaged position and backward-engaged position, back edge 154 and front edge 152 are made to alternate between allowing objects to pass and preventing objects to pass. In forward-engaged position, objects pass under back edge 154 but are stopped by front edge 152, thus "filling" the space underneath tilt tray 150 along length L. When tilt tray 150 is pivoted to backward-engaged position, back edge 154 comes down to prevent movement of objects above the back edge, while front edge 152 comes up to allow movement of objects below the back edge 154 towards dispensing guide 132. Tilt tray 150 is then returned to forward-engaged position, allowing another collection of objects to pass under back edge 154, yet be stopped by front edge 152. Thus, pivoting tilt tray 150 between forward-engaged position and backward-engaged position discharges uniformly sized groups of objects from inclined column guide 110 to dispensing guide 132. In some embodiments, tilt tray 150 includes a handle 156.

Figure 1F:
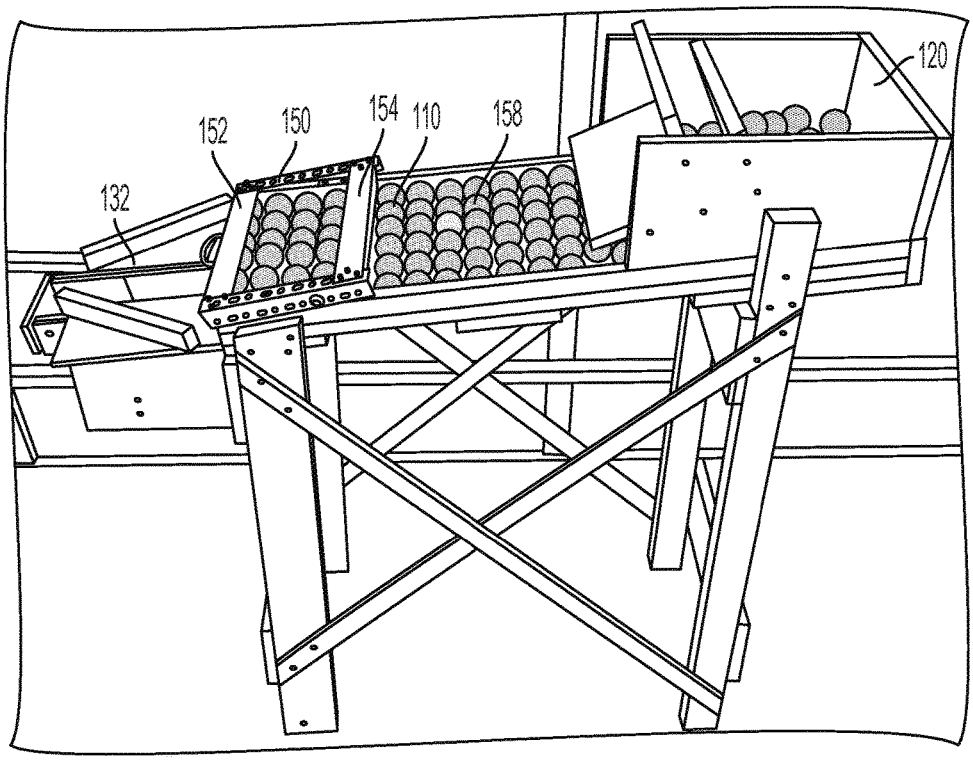
FIG. 1F a schematic diagram of a system for packaging objects according to some embodiments of the present disclosure.

Referring now to FIG. 1F, the size of these uniformly sized groups may be changed by varying the number of guiding columns 112, size of tilt tray 150, and the size of the objects to be packaged. In one preferred embodiment, system 100 is configured to package golf balls 158. In these embodiments, tilt tray 150 has a length L of about 8.6 inches. Tilt tray 150 pivots at a point approximately 6 inches from front edge 152. Front edge 152 and back edge 154 extend about 0.6 to about 0.7 inches from the tilt tray towards inclined column guide 110. In this exemplary embodiment, six guiding columns 112 are used, and tilt tray 150 has a width of about 12.75 inches to accommodate those guiding columns. Tilt tray 150 is thus sized to fit a column of 5 golf balls between front edge 152 and back edge 154. This embodiment reliably produces uniform groups of 30 golf balls. When in forward-engaged position, 6 columns of golf balls advance under back edge 154 and are subsequently stopped by front edge 152. When pivoted to backward-engaged position, back edge 154 is lowered to separate those golf balls above it from those golf balls below it. At substantially the same time, front edge 152 rises, allowing the golf balls to advance down inclined column guide 110. Lowered back edge 154 ensures only the uniform 30 golf ball group is allowed to advance at that time. The uniform 30 golf ball group is then conveyed by inclined column guide 110 to dispensing guide 132, where the objects are funneled to object container 134.

Systems and methods of the present disclosure are advantageous in that they enable consistent packaging of objects while remaining easy to operate. The tilt tray prevents objects added to the system for packaging from leaving the system via the dispensing guide unless a system user desires they do so. Thus, users are free to add objects in bulk via the reservoir and at their own pace, and are also free to leave objects in the system for packaging in the future when it would be more convenient. The inclined column guide allows for self-feeding, highly efficient packaging of objects that may, through their size, shape and number, be inherently difficult or cumbersome to handle, such as a large collection of golf balls. Finally, as discussed above, the tilt tray produces uniform groups of objects for packaging with a simple, easily controlled motion, which can be repeated in quick succession to produce a plurality of substantially identical packages from a comparatively disordered collection of objects.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. A system for packaging golf balls comprising:

a base tray having a first end and a second end;

a reservoir positioned at said first end;

a ball guide positioned at said second end, said ball guide having a base, said base having a trough therein;

an inclined column guide positioned between said reservoir and the ball guide, said inclined column guide having two or more longitudinally extending guiding columns;

a tilt tray positioned above said column guide, said tilt tray anchored to pivot between a forward-engaged position and a backward-engaged position;

an interchangeable ball container; and a dispensing conduit positioned at said ball guide to receive golf balls from said trough and direct the golf balls via an opening in the dispensing conduit to the interchangeable ball container, wherein said tilt tray has a front edge and a back edge, wherein said back edge is positioned at a first height above said inclined column guide when said tilt tray is in said forward-engaged position and a second height above said inclined column guide when said tilt tray is in said backward-engaged position, and wherein said front edge is positioned at a third height when said tilt tray is in said backward-engaged position and a fourth height above said included column guide when said tilt tray is in said forward-engaged position, and wherein said first height and said third height are sized to allow a golf ball to pass underneath, and said second height and said fourth height are sized to prevent a golf ball to pass underneath.

2. The system of claim 1, wherein said interchangeable ball container is configured to reversibly attach to an outer surface of the dispensing conduit.

3. The system of claim 1, wherein said reservoir includes a vertical baffle.

4. The system of claim 1, further comprising a horizontal baffle extending longitudinally along said inclined column guide.

5. The system of claim 1, wherein said base tray includes side walls, wherein said tilt tray is fastened to said side walls at said pivot point.

6. The system of claim 1, wherein said guiding column is sized to receive a single column of golf balls.

7. The system of claim 6, wherein said guiding column include a first edge, a second edge, and a recess therebetween.

8. The system of claim 1, wherein said tilt tray has a length of about 8.6 inches and a width of about 12.75 inches, and said tilt tray includes a pivot point about 6 inches from said front edge.

9. The system of claim 8, wherein said back edge extends from said tilt tray about 0.6 to about 0.7 inches towards said inclined column guide.

10. The system of claim 1, wherein said ball guide includes non-parallel guiding walls configured to funnel towards said interchangeable ball container.

11. The system of claim 10, wherein said non-parallel guiding walls are positioned with a first distance therebetween of approximately 6 golf balls, and a second distance therebetween of approximately 2 golf balls to approximately 3 golf balls.

12. An object packaging system comprising:

a base tray having a first end and a second end;

a reservoir positioned above said first end, said reservoir including side walls and at least one vertical baffle;

a dispensing guide positioned at said second end, said dispensing guide having a base, said base having a trough therein;

an inclined column guide in communication with said reservoir and said dispensing guide, said inclined column guide having two or more longitudinally extending guiding columns;

a horizontal baffle extending from said reservoir longitudinally along said column guide;

a tilt tray positioned above said inclined column guide having a front edge and a back edge, said tilt tray anchored to pivot between a forward-engaged position and a backward-engaged position;

an interchangeable object container; and a dispensing conduit connected to the dispensing guide to receive objects from said trough and direct the objects via an opening in the dispensing conduit to the interchangeable object container, wherein said back edge is positioned to prevent object movement along said inclined column guide when said tilt tray is in said backward-engaged position, and said front edge is positioned to prevent object movement into said dispensing guide when said tilt tray is in said forward-engaged position.

13. The object dispenser according to claim 12, said reservoir having a reservoir base, said reservoir base being substantially planar.

14. The object dispenser according to claim 12, wherein said dispensing guide includes a base and a trough extending along said base, said trough in communication with an object container.

15. The object dispenser according to claim 12, wherein said at least one vertical baffle includes an inner vertical baffle and an outer vertical baffle, and further comprising a recess between said inner vertical baffle and said outer vertical baffle.

16. The object dispenser according to claim 12, wherein said dispensing conduit is configured to interface with interchangeable object containers.

* * * * *